US005213528A

United States Patent [19]

Seiford, Sr.

[11] Patent Number: 5,213,528

[45] Date of Patent: May 25, 1993

[54] PADDLE WHEEL FOR A SHIP

[76] Inventor: Donald S. Seiford, Sr., 5685 Annette Ave., E., Inver Grove Heights, Minn. 55077

[21] Appl. No.: 872,253

[22] Filed: Apr. 22, 1992

[51] Int. Cl.[5] ..... B63H 1/04

[52] U.S. Cl. ..... 440/90; 416/117

[58] Field of Search ..... 440/90–97; 416/117, 139, 144; 415/7

[56] References Cited

U.S. PATENT DOCUMENTS 3,129 6/1843 Everett .
124,348 3/1872 Frackmann .
150,956 5/1874 Hunter .
729,397 5/1903 Nowak .
1,540,257 6/1925 Doehlert, Jr. .
3,027,863 4/1962 Town ..... 440/92

*Primary Examiner*—D. Jesûs Sotelo
*Attorney, Agent, or Firm*—Edwin E. Greigg; Ronald E. Greigg

[57] ABSTRACT

A paddle wheel for propelling a water craft. The paddle wheel includes a plurality of oppositely disposed paddles which are rotatable with a supporting shaft. Each of the paddles are formed with side and end plates with a rounded portion between the outer edges of the sides. The bottom half portion of the paddles is filled with concrete and the upper half is filled with air or evacuated. Thus, the paddles remain in a vertical position as the paddle wheel rotates.

24 Claims, 3 Drawing Sheets

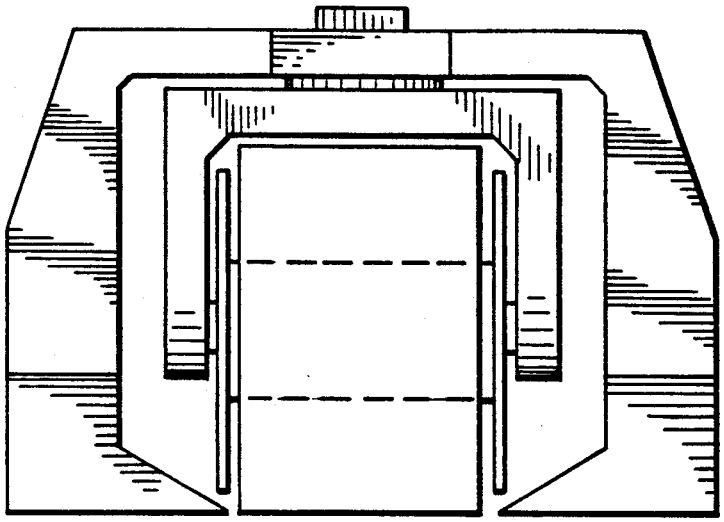
FIG. 3
FIG. 4
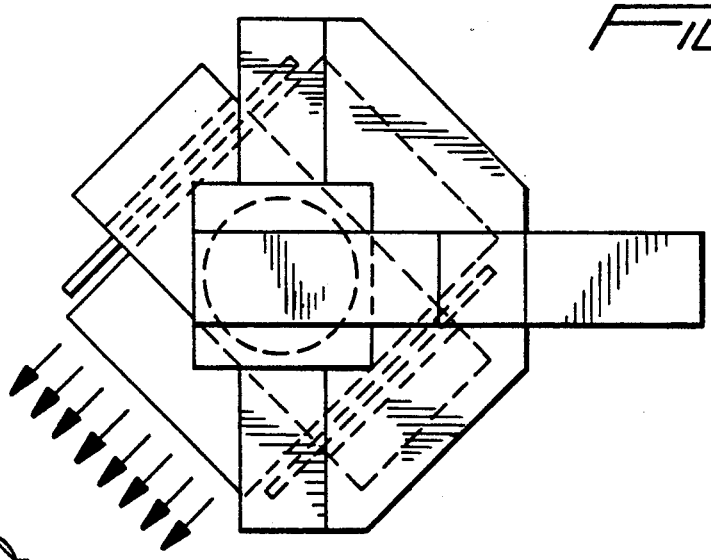
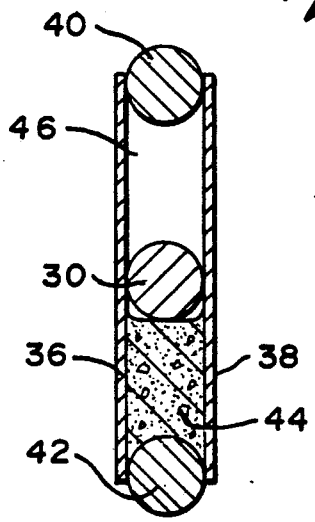
FIG. 5

PADDLE WHEEL FOR A SHIP

BACKGROUND OF THE INVENTION

This invention is directed to an improved paddle wheel for a ship, a barge or any other vessel for movement in a water surroundings.

Heretofore paddle wheels have been used in which the paddle structure of the wheel is stationary within the wheel so that the paddles dc not move as the wheel rotates. Such paddle wheels have their drawbacks because the paddles carry water with the paddle as it leaves the water and the paddle enters and leaves the water at an angle with reference to the plane of the water surface.

Paddle wheels have been made in which the paddles are moveable relative to the water so that the paddle is perpendicular to a plane of the water when entering or leaving the water. Such paddles have been driven or rotated by use of mechanical levers, gears, rotating wheels, etc. so, that a mechanical means is required in combination with the paddle in order to position the paddles relative to the water. Such patents are U.S. Pat. Nos. 3,129; 124,348; 150,956; 729,397; and 1,540,257.

This invention does not make use of any gear, chains, or mechanical devices connected to a paddle of a paddle wheel for always positioning the paddles in a vertical position.

OBJECT AND SUMMARY OF THE INVENTION

It is therefore an object of the invention to provide a paddle wheel in which the paddles of the paddle wheel are rotatable with a shaft to which the paddle is fixed so that the paddle is always in a vertical position.

Another object is to provide a paddle wheel in which the paddles are always in a vertical position without the use of any mechanical means secured thereto.

Still another object is to provide a paddle wheel in which the paddles are fixed and centered on a shaft in which the paddle is formed by use of an elongated hollow body in which the bottom half of the hollow body is filled with a weight such as metal or concrete and the upper half is enclosed to include air or can be evacuated.

Yet another object is to form a paddle body filled with a weight on its lower half in which the body is rounded or pointed along its lower and upper edges for easy entry into the water.

Other objects and advantages thereof will become more apparent from the ensuing detailed description of preferred embodiments taken in conjunction with the drawings.

BRIEF DESCRIPTION OF THE DRAWINGS

FIG. 3 illustrates a rear view of the paddle wheel in the support structure.

FIG. 4 illustrates the paddle wheel at an angle with the center of a barge illustrating its use for steering the barge; and FIG. 5 is a cross-section of a paddle used in the paddle wheel.

Figure 1:
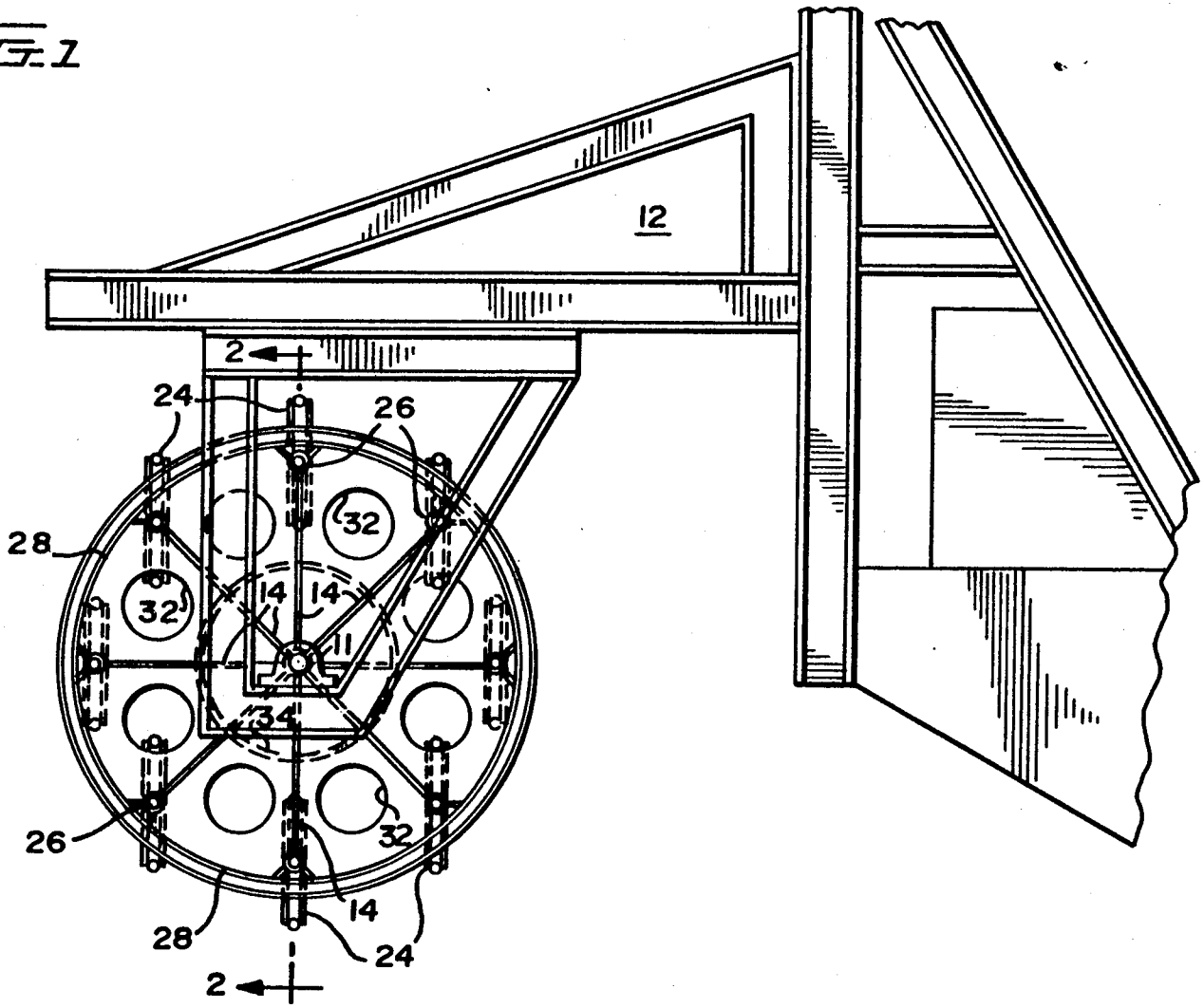
FIG. 1 is an end view of a paddle wheel including paddles made in accordance with this invention secured to the rear of a barge.

Now referring to the drawings, there is shown in FIG. 1 an end view of a paddle wheel 10 made in accordance with this invention and secured to frame 12 which may be raised and lowered by any suitable mechanical means in accordance with the water level on the vessel. The means for raising and lowering the frame and paddle wheel forms no part of this invention. The paddle wheel includes radially extending equal length supports 14 to which side plates 16 and 18 are secured to hold the supports in place. The supports and side plates are concentrically mounted on a shaft 20 which is supported in bushings or journal boxes 11 at each end of the shaft and supported on the frame 12. The number of supports 14 is the same as the number of paddles 24 since the paddles are secured by a shaft 30 in a journal box or bushing 26 on ar outer end of each of the supports 14. The outer ends of the bushings 26 are secured to an outer rim 28. The side plates are shown with holes 32 which cut down on the weight of the paddle wheel.

Figure 2:
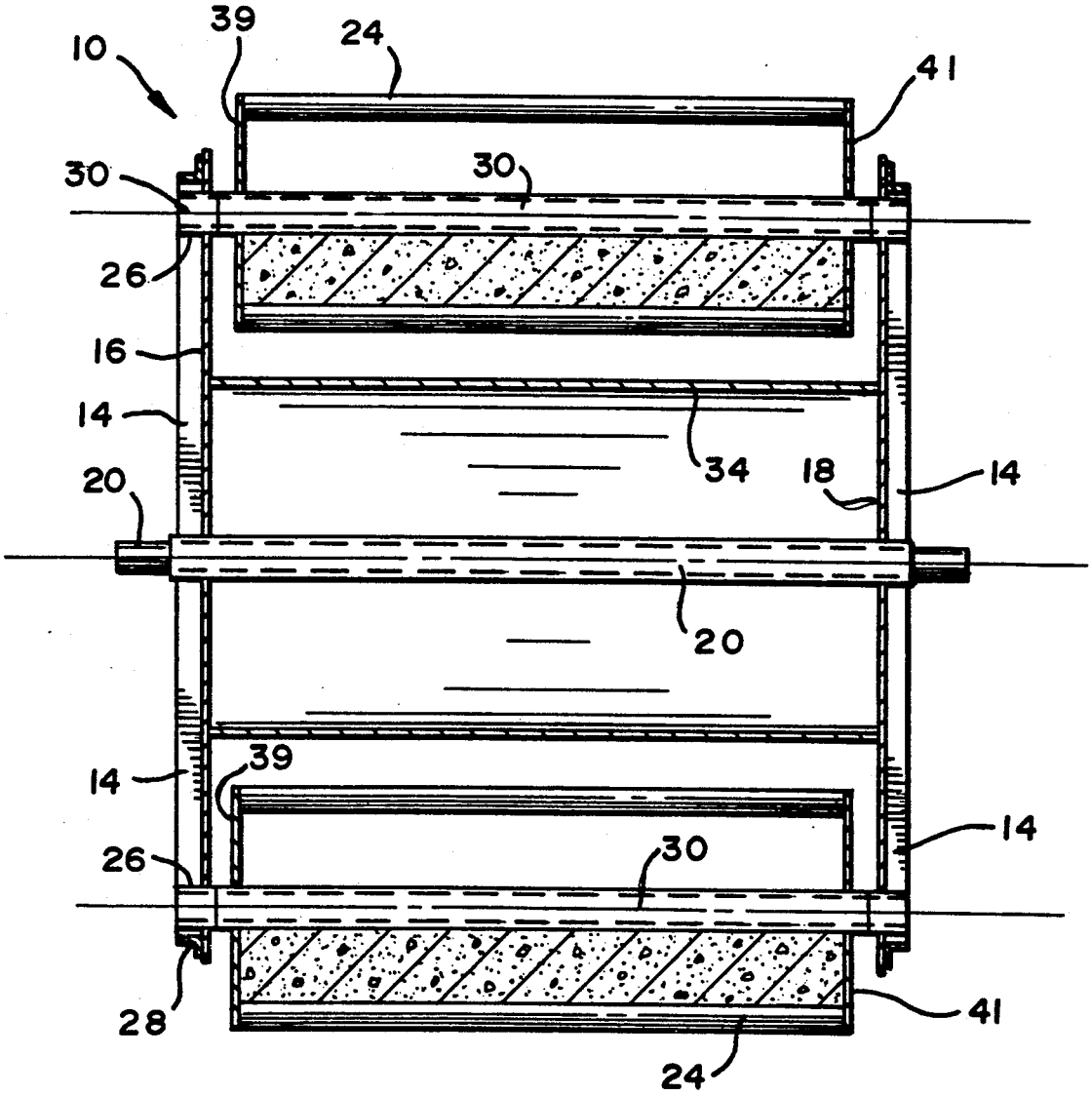
FIG. 2 is a cross-sectional view along section 2—2 of FIG. 1.

FIG. 2 is a cross sectional view of the paddle wheel illustrating the paddles 24, the shaft 30 with which the paddles rotate, the central shaft 20 of the paddle wheel the side plates 16 and 18, the radially extending supports 14 and the outer rim 28. FIG. 2 illustrates an enclosed cylindrical closed cylinder 34 concentric with the paddle wheel shaft with the paddle wheel journaled outside of the ends of the central cylinder. The central cylinder is secured at its ends to the side plates 16 and 18 for assisting in stabilizing the support of the paddle wheel.

FIG. 3 illustrates a rear view of the paddle wheel supported in the frame 12.

FIG. 4 illustrates the paddle wheel rotated 90° for the purpose of steering the vessel.

FIG. 5 illustrates a cross sectional view of a paddle 24. As shown in FIG. 5, the paddle includes parallel side plates 36 and 38 secured to a central shaft 30 with which the paddle rotates. The upper and lower edges of the paddle between &:he paddle plates are rounded by use of rods 40, 42 to which the edges of the side plates 36 and 38 are secured at the diameter of the rods. The ends of the side plates are enclosed by use of end plates 39 and 41. The bottom half of the paddle is substantially filled with concrete 44 or some other heavy material such as metal, sand, etc. The type of material is not important. The important feature is that the bottom half of the paddle must be much, much heavier than the upper half. The upper half 46 of the paddle includes air or it could be evacuated.

The paddles and paddle wheel may be made of any desired size. For illustrative purposes, the paddle wheel may be six feet between the side plates 16 and 18 with a diameter of seven feet. The paddles may have a length of five and one-half feet with an overall height of two feet and a width of about three inches. The shaft for the paddle is approximately 6½ feet with a diameter about 2½ inches and the shaft for the paddle wheel is about 3 inches in diameter with a length of about seven feet. The paddles can be spaced about 6 feet centered on their diameter. As shown, there are eight paddles so the paddles will be spaced forty-five degrees apart such that the paddles will be diagonally opposite from each other.

In operation, the paddle wheel is assembled and supported in the frame for rotation in a journal box or bushings. The paddle wheel is driven , raised and lowered and moved for steering hydraulically which is not a part of the invention. The manner in which it is driven, raised, lowered, and positioned for steering forms no part of this invention. In use, the paddle wheel is rotated and as the paddle wheel is rotated, the paddles will remain in a vertical position because of the heavy weight in the bottom portion. Since the paddle is in a vertical position and has a rounded or pointed edge, the paddle will enter the water and leave the water in a vertical position. In fact, the paddle will remain in a vertical position during a complete rotation of the paddle wheel. Further, since the paddle is rounded along its edges the paddle will enter the water with little resistance and will not carry any water with the paddle upon leaving the water. As the paddle moves in the water, the paddle will remain in a vertical position because of a combination of the weight in the bottom portion and the buoyancy of the top portion. Further, the area of the paddle above and below the horizontal axis is the same, so the force of the water on the upper and bottom portion will be the same. Because of the weighted bottom, the paddle will remain in a vertical position on entering and leaving the water and due to the rounded face the paddle will not carry any water with the paddle.

It is believed that the paddle wheel is much more efficient than known paddle wheels, it can be made smaller in diameter, lighter n weight and can be made to appear in appearance as any other paddle wheel. Because of the small size and vertical adjustability, the paddle wheel can be used in shallow water as well as in deep water.

The paddle wheel, as set forth herein, could be used in a water flow path for a mechanical connection to a generator for generating electricity as well as for propelling a water bearing vessel.

The foregoing relates to a preferred exemplary embodiment of the invention, it being understood that other variants and embodiments thereof are possible within the spirit and scope of the invention, the latter being defined by the appended claims.

I claim:

1. A paddle for a paddle wheel of a vessel for use in water which comprises an elongated body including parallel side plates (36, 38), an edge enclosure means (40, 42) between upper and lower edges of said side plates, end plates (39, 41) which enclose said parallel plates, a support shaft means which extends form said end plates along a linear axis which divides said paddle into equal upper and lower portions, said lower portion of said paddle is filled with a heavy material and said upper portion is absent of any such heavy weighted material.

2. A paddle as set forth in claim 1, in which said heavy material is concrete.

3. A paddle as set forth in claim 1 in which said edge enclosure means is round with a rounded portion extending outward of said edges.

4. A paddle as set forth in claim 3, in which said support shaft means extends through said paddle along said axis with end portions extending form said end plates.

5. A paddle as set forth in claim 1 in which said support shaft means extends through said paddle along said axis with end portions extending form said end plates.

6. A paddle as set forth in claim 1, in which said heavy material is metallic.

7. A paddle as set forth in claim 1, in which said heavy material is sand.

8. A paddle as set forth in claim 1, in which said heavy material is heavy plastics.

9. A paddle wheel rotatable on a main shaft (20), said paddle wheel including a plurality of paddles each of which is rotatable with secondary end supports (30) and retained in a vertical position during rotation of said paddle wheel, each of said paddles include elongated parallel side plates which are closed along their upper and lower edges by an edge enclosure (40, 42) and closed on their ends to form a hollow body, in which said secondary end supports (30) are on a linear axis which divides said hollow body into equal upper and lower portions, said lower portion of said hollow body is filled with a heavy weighted material and said upper portion is absent of any such heavy weighted material.

10. A paddle as set forth in claim 9, in which said heavy material is concrete.

11. A paddle wheel as set forth in claim 10, in which said main shaft is supported in a support bearing of a supporting frame for rotation of said paddle wheel in a vertical plane and for movement about an axis in a horizontal plane.

12. A paddle wheel as set forth in claim 9 in which said paddle wheel includes radially extending support arms of equal length which are centered on said main shaft (20) and each of said paddles is supported by its secondary end supports supported in a bushing on an outer end of each of said radially extending support arms (14).

13. A paddle wheel as set forth in claim 12 in which said paddle wheel includes side plates (16, 18) which are secured to each of said support arms concentric with said main shaft, and each of said secondary end supports extend through said side plates to be secured onto said support arms.

14. A paddle wheel as set forth in claim 13 which includes a cylindrical cylinder concentric with said main shaft positioned between said side plates and secured at opposite ends to said side plates.

15. A paddle wheel as set forth in claim 14 in which said main shaft is supported in a support bearing of a supporting frame for rotation of said paddle wheel in a vertical plane and for movement about an axis in a horizontal plane.

16. A paddle wheel as set forth in claim 13 in which said main shaft is supported in a support bearing of a supporting frame for rotation of said paddle wheel in a vertical plane and for movement about an axis in a horizontal plane.

17. A paddle wheel as set forth in claim 12 in which said main shaft is supported in a support bearing of a supporting frame for rotation of said paddle wheel in a vertical plane and for movement about an axis in a horizontal plane.

18. A paddle wheel as set forth in claim 9 in which said main shaft is supported in a support bearing of a supporting frame for rotation of said paddle wheel in a vertical plane and for movement about an axis in a horizontal plane.

19. A paddle wheel as set forth in claim 9 in which said edge enclosure means is sound with a rounded portion extending outward of said edges.

20. A paddle as set forth in claim 19 in which said support means extends through said paddle along said axis with end portions extending from said end plates.

21. A paddle as set forth in claim 9 in which said support shaft means extends through said paddle along said axis with end portions extending from said end plates.

22. A paddle as set forth in claim 9 in which said heavy material is metallic.

23. A paddle as set forth in claim 9 in which said heavy material is sand.

24. A paddle as set forth in claim 9 in which said heavy material is heavy plastics.

* * * * *